US011559080B2

(12) United States Patent
Braunshteyn et al.

(10) Patent No.: US 11,559,080 B2
(45) Date of Patent: Jan. 24, 2023

(54) COMPOUND HORIZONTAL FILTER ASSEMBLY MACHINE AND PROCESS

(71) Applicant: Philip Morris USA Inc., Richmond, VA (US)

(72) Inventors: Michael S. Braunshteyn, Richmond, VA (US); Raquel M. Olegario, Richmond, VA (US)

(73) Assignee: Philip Morris USA Inc., Richmond, VA (US)

( * ) Notice: Subject to any disclaimer, the term of this patent is extended or adjusted under 35 U.S.C. 154(b) by 849 days.

(21) Appl. No.: 16/419,381

(22) Filed: May 22, 2019

(65) Prior Publication Data

US 2019/0269171 A1 Sep. 5, 2019

Related U.S. Application Data

(63) Continuation of application No. 12/979,430, filed on Dec. 28, 2010, now Pat. No. 10,299,507.

(60) Provisional application No. 61/291,112, filed on Dec. 30, 2009.

(51) Int. Cl.
*A24C 5/47* (2006.01)
*A24D 3/02* (2006.01)

(52) U.S. Cl.
CPC ..... *A24D 3/0287* (2013.01)

(58) Field of Classification Search
None
See application file for complete search history.

(56) References Cited

U.S. PATENT DOCUMENTS

| | | | | |
|---|---|---|---|---|
| 2,882,970 | A | 4/1959 | Schur | |
| 3,517,480 | A | 6/1970 | Pinkham | |
| 3,603,058 | A | 9/1971 | Schubert | |
| 4,010,678 | A * | 3/1977 | Greve et al. | A24D 3/0287 493/48 |
| 2002/0119874 | A1 | 8/2002 | Heitmann et al. | |
| 2004/0237972 | A1 | 12/2004 | Horn et al. | |

(Continued)

FOREIGN PATENT DOCUMENTS

GB 623964 A 5/1949

OTHER PUBLICATIONS

Notification of Transmittal of the International Search Report and the Written Opinion of the International Searching Authority for PCT/IB2010/003483, dated May 27, 2011, with ISR and Written Opinion attached.

(Continued)

*Primary Examiner* — Dionne W. Mayes
(74) *Attorney, Agent, or Firm* — Harness, Dickey & Pierce, P.L.C.

(57) ABSTRACT

An apparatus and processes for producing compound cigarette filters by horizontally assembling multiple filter segments onto the horizontally oriented transverse flutes of a continuous belt. Spaced apart hoppers are serially arranged above the belt, and each hopper contains at least one of the multiple segments of the compound filter being assembled. A transfer structure between each hopper and the belt serially delivers the filter segments to the flutes on the belt, and after such assembly the various filter segments are removed as a group from each flute of the continuous belt. The filter segments are then combined as a group with wrapped tobacco rods to thereby produce filtered cigarettes.

13 Claims, 2 Drawing Sheets

(56) References Cited

U.S. PATENT DOCUMENTS

| | | | | |
|---|---|---|---|---|
| 2006/0157070 | A1* | 7/2006 | Belcastro et al. ..... | A24C 5/475<br>131/94 |
| 2006/0196513 | A1 | 9/2006 | Atwell et al. | |
| 2008/0156337 | A1 | 7/2008 | Evans et al. | |

OTHER PUBLICATIONS

International Preliminary Report on Patentability and Written Opinion of the international Searching Authority dated Jul. 12, 2012.

* cited by examiner 10
12
14
16
18
20
22
24
26
28
30
32
34
36
38
40
42
46
48
50
52
54
56
58
60
62
64
66
68
70
72
74
76
78
80

COMPOUND HORIZONTAL FILTER ASSEMBLY MACHINE AND PROCESS

CROSS-REFERENCE TO RELATED APPLICATIONS

This is a continuation application of U.S. application Ser. No. 12/979,430, filed Dec. 28, 2010, which claims benefit of priority under 35 U.S.C. § 120 to, U.S. Application No. 61/291,112, filed Dec. 30, 2009, the entire contents of each of which are incorporated herein by reference.

BACKGROUND OF THE INVENTION

The present invention relates to the production of compound filters, and more particularly to horizontal assembly of multiple filter components of compound cigarette filters.

U.S. Pat. Nos. 3,517,480 and 3,603,058 illustrate and describe machines for the production of composite cigarette filters by directly flowing granular filter material from a storage hopper into a vertically oriented filter tube made of paper. Similarly, US Patent Application Publication 2002/0119874A1 describes another vertical filling machine for producing compound cigarette filters that includes a series of rotating plates with cavities therein into which the granular filter material is deposited. The cavities ultimately are aligned with a vertically oriented open ended filter tube of paper to facilitate deposit of the granular material into the tube. These machines have the disadvantage of often destroying the integrity of the paper filter tubes into which filter materials are deposited. They also deposit imprecise amounts of granular material and produce undesired amounts of fine dust and the like.

Co-pending and commonly assigned application Ser. No. 11/268,291, filed Nov. 4, 2005, also relates to machinery and processes for producing compound cigarette filters utilizing vertical filling techniques that avoid the disadvantages of the above-described disclosures. However, the invention of this application also relies on vertical procedures for compound filter assembly.

SUMMARY OF THE INVENTION

Accordingly, one of the objects of the present invention is a machine and process for producing multiple component cigarette filters where the components are horizontally assembled in a highly efficient and economical manner at high rates of production.

Another object of the present invention is a machine and process having the ability to horizontally assemble very small filter components less than three millimeters in length.

Another object of the present invention is a machine and process for producing multiple compound cigarette filters, which includes precise location of multiple filter components in a horizontal array during filter assembly.

Still another object of the present invention is a machine and process for producing compound cigarette filters with minimal or no cross contamination of filter material, whereby extremely clean filters are produced.

According to the present invention, an apparatus is provided for producing compound cigarette filters by horizontally assembling multiple filter segments, which subsequently are collectively wrapped with tipping paper for joining the multiple filter segments to wrapped tobacco rods. A continuous belt has transverse horizontally oriented flutes on the outside thereof, and spaced apart hoppers are positioned above the belt, each hopper containing at least one of the multiple segments of the compound cigarette filter being assembled. A structure is provided between each hopper and the belt for serially delivering the filter segments from the hoppers to the flutes on the belt. Finally, a take-off structure receives each assembled compound filter from the flutes of the continuous belt for subsequent wrapping and combining with wrapped tobacco rods.

Preferably the fluted belt is trained around a pair of spaced apart drums, at least one of which is driven. Each drum has a horizontal axis of rotation and the axes are parallel to one another. Complimentary sprockets may be provided on the outside of the drums and the underside of the belt for interlocking engagement with one another.

Preferably, the transfer structure between each hopper and the fluted belt includes a cooperating fluted vacuum drum for properly positioning and placement of the filter segments onto the flutes of the continuous belt. The take-off structure may also include a cooperating fluted vacuum drum for removing each assembled compound filter from the flutes of the continuous belt and for delivering each assembled component filter in a downstream direction.

Each assembled compound filter is subsequently abutted with wrapped tobacco rods, one at each end of the compound filter, and tipping paper is utilized to secure the tobacco rods to the compound filter.

Ultimately, the compound filter is cut in two at its midpoint to thereby produce two cigarettes, each comprising a compound filter with a wrapped tobacco rod secured thereto with tipping paper.

Additionally, according to the present invention, a process is provided for producing compound cigarette filters by horizontally assembling multiple filter segments that comprise the compound filter. The process steps include moving a continuous belt with transverse horizontally oriented flutes on the outside thereof in a downstream direction. Multiple filter segments are serially delivered onto each flute of the belt sufficient to produce two filters. Once the filter segments are horizontally assembled onto the fluted belt, the segments are removed as a group and wrapped tobacco rods are then secured to each end of the assembled multiple filter segments with tipping paper. The compound filter is then cut in two at its midpoint to thereby produce two cigarettes each comprising a compound filter with a wrapped tobacco rod secured thereto.

BRIEF DESCRIPTION OF THE DRAWINGS

Novel features and advantages of the present invention in addition to those noted above will be become apparent to persons of ordinary skill in the art from a reading of the following detailed description in conjunction with the accompanying drawings wherein similar reference characters refer to similar parts and in which.

DETAILED DESCRIPTION OF THE INVENTION

Figures 1, 2:
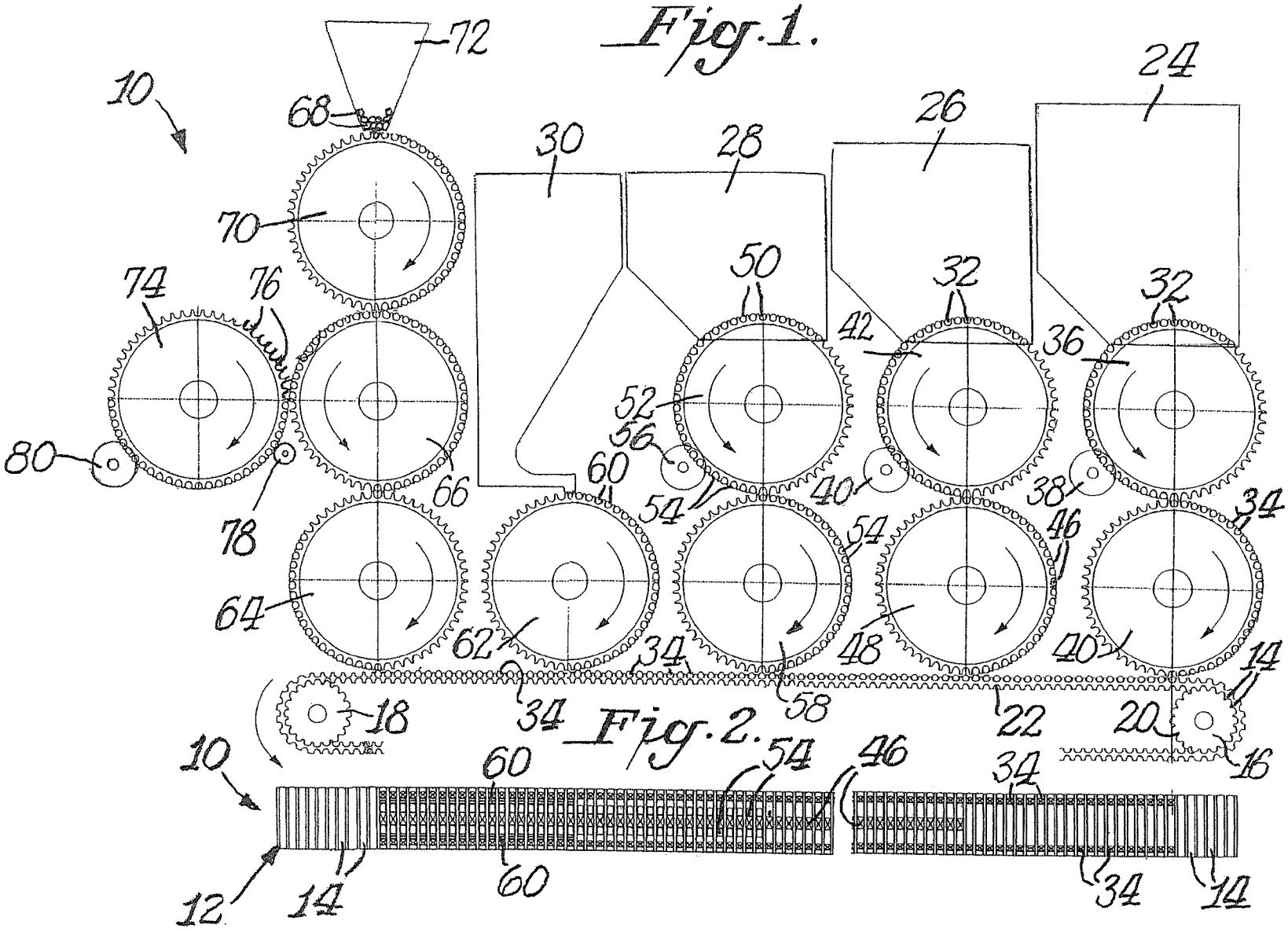
FIG. 1 is a side elevational view of a machine for producing compound cigarette filters by horizontally positioning the filter components during filter assembly, according to the present invention.
FIG. 2 is a sectional view taken along line 2-2 of FIG. 1.
Figure 3:
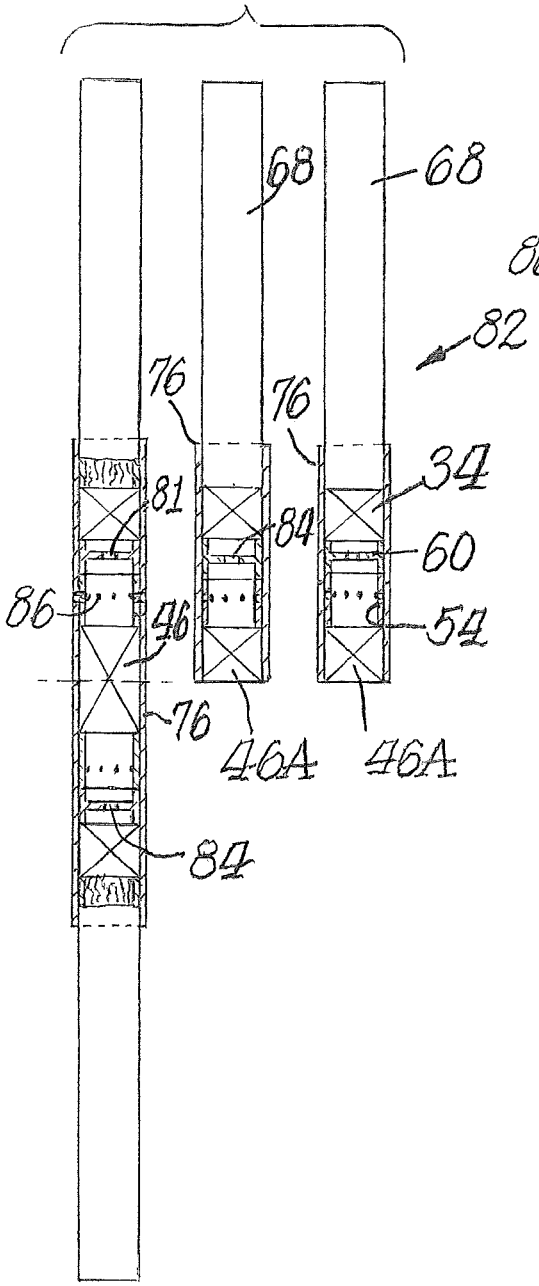
FIG. 3 is a top plan view of a 2-up filter assembly (2 filters) with wrapped tobacco rods at each end of the assembly secured thereto by tipping paper, and further showing the filter assembly cut at its midpoint to produce two cigarettes.
Figure 4:
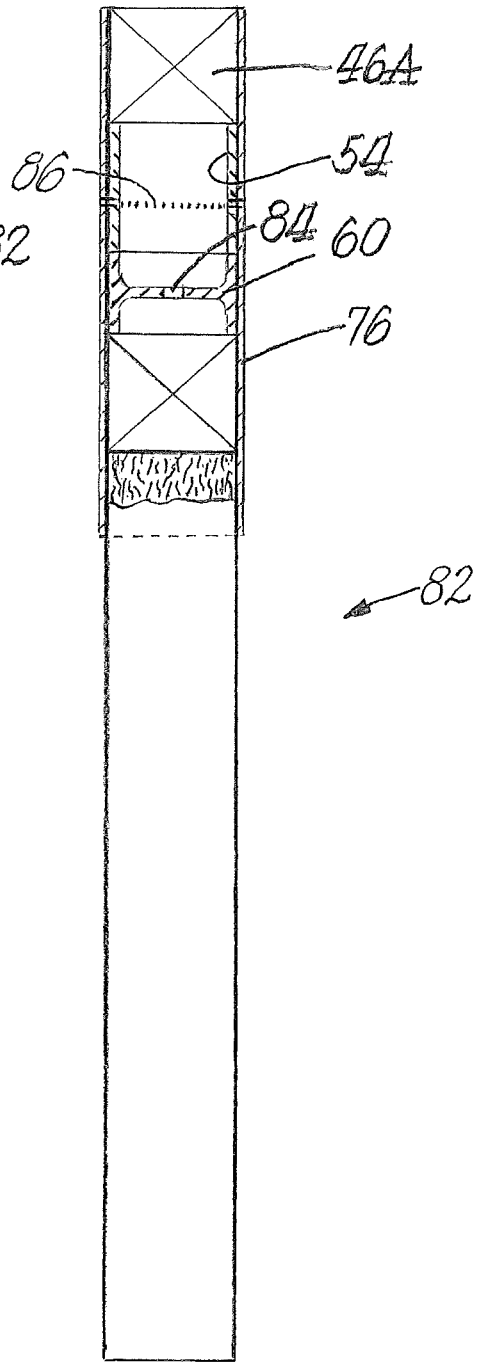
FIG. 4 is an enlarge view of one of the two cigarettes shown in FIG. 3.

Referring particularly to the drawings, FIGS. 1 and 2 illustrate an apparatus 10 for producing compound cigarette filters by horizontally assembling multiple filter segments that together comprise the compound filters.

Apparatus 10 includes a continuous belt 12 with transverse horizontally oriented flutes 14 on the outside of the belt. The belt 12 is trained around a pair of spaced apart drums 16, 18 at least one of which is driven. Each drum has a horizontal axis of rotation and the axes are parallel to one another. Sprockets 20 are formed on the outside of each drum 16, 18, and the underside of the belt 12 includes complementary sprockets 22 for interlocking engagement with the sprockets on the drums. This provides a positive drive for moving the belt 12 in a downstream direction.

Spaced apart hoppers above the belt are serially arranged along the path of travel of the belt as it moves in a downstream direction. In the embodiment of the invention shown in FIGS. 1 and 2, a first hopper 24, second hopper 26, third hopper 28 and fourth hopper 30 each contain a variety of filter segments for producing the compound cigarette filter being assembled.

By way of example, the first hopper 24 may include cellulose acetate rods 32 for producing and depositing first filter segments 34 onto the flutes 14 of belt 12. In this regard, the rods 32 are removed from the hopper 24 by a fluted vacuum drum 36, and the first filter segments 34 are cut from these rods with knife 38. The first filter segments 34 are then transferred to fluted vacuum drum 40 where the segments 34 are moved within the flutes of drum 40 by vacuum for ultimate deposit on each flute 14 of belt 12. As shown in FIG. 2, each of the first filter segments may comprise a cellulose acetate plug about five centimeters in length.

The second hopper 26 may also include cellulose acetate rods 32 which are transferred from the hopper to a fluted vacuum drum 42 for movement through a knife 40 which cuts second filter segments 46 from the rods. The second filter segments are then transferred to a fluted vacuum drum 48 where the segments are moved within the flutes of drum 48 by vacuum for subsequent positioning in the middle of each flute 14 on belt 12. The second filter segment 46 may be ten centimeters in length.

The third hopper 28 may include a supply of tubular filter rods 50 with spaced apart ventilation holes along the length thereof as explained more fully below. The tubular filter rods 50 are removed from hopper 28 by fluted vacuum drum 52, and third filter segments 54 are cut from the rods by knife 56, Fluted vacuum drum 58 receives and properly positions the third filter segments 54 along the flutes thereof by vacuum for deposit on opposite sides of the center second filter segment in each flute 14 of belt 12.

The fourth and final hopper 30 contains the fourth filter segments 60 each of which may comprise a flow restricting filter segment, as explained more fully below. A fluted vacuum drum 62 receives the fourth filter segments from hopper 30 and these segments are moved along the flutes of drum 62 by vacuum for deposit on the flutes 14 of belt 12. A pair of filter segments 60 are placed on each flute 14, one between each of the first and third filter segments already positioned on the belt.

As explained more fully below, the final assembly of filter segments on each of the flutes 14 of belt 12 comprises a so-called 2-up compound filter, and cutting the 2-up compound filter at the midpoint of the second centrally positioned cellulose acetate filter segment 46 produces two compound cigarette filters.

After the 2-up compound filter is horizontally assembled as explained above, all the assembled filter segments are removed as a group from each flute 14 of the belt 12. A fluted vacuum drum 64 is provided for this purpose, and the drum is positioned at the downstream end of belt 12 as shown in FIG. 1. The 2-up compound filter is then transferred from drum 64 to a cooperating fluted vacuum drum 66 where wrapped tobacco rods 68 from drum 70 and supply 72 are assembled next the ends of the 2-up filter. Ultimately a wrapped tobacco rod abuts each end of the 2-up filter on the drum 66.

The 2-up compound filter with tobacco rods 68 at the ends thereof is then transferred to a third fluted vacuum drum 74 where tipping paper 76 is wrapped around the 2-up filter and portions of the tobacco rods by roller 78 to join the filter to the rods. A knife 80 then cuts the second filter segment 46 in half to thereby produce two cigarettes 82, each comprising a wrapped tobacco rod 68 and a compound filter containing four filter segments 34, 60, 54 and 46A (half of segment 46).

By way of example, filter segments 34 and 46A each comprise cellulose acetate tow. Filter segment 60 is a flow restrictor having a central opening 84 of 0.4 mm to 0.8 mm in diameter as shown. The tubular filter segment 54 includes a ventilation zone 86, and the tipping paper may include cooperating ventilation, if desired.

What is claimed is:

1. An apparatus for producing compound cigarette filters by horizontally assembling multiple filter segments, the apparatus comprising:

a continuous belt including a plurality of flutes on an outside of the continuous belt, each of the plurality of flutes extending transversely across the continuous belt, the plurality of flutes including a first flute;

a plurality of spaced apart hoppers above the continuous belt, the plurality of spaced apart hoppers including, a first hopper configured to supply a pair of first filter segments, a second hopper configured to supply a second filter segment different than the pair of first filter segments, and a third hopper configured to supply a pair of third filter segments;

at least one drum between each hopper and the continuous belt, the at least one drum including, a first drum configured to deliver a first filter segment of the pair of first filter segments from the first hopper to a first end of the first flute and a second filter segment of the pair of first filter segments to a second end of the first flute opposite the first end, a second drum configured to deliver the second filter segment from the second hopper to a position between the pair of first filter segments in the first flute, and a third drum configured to deliver the pair of third filter segments from the third hopper to the first flute, the third drum delivering the pair of third filter segments to positions adjacent opposite ends of the second filter segment; and a takeoff drum configured to remove an assembled compound filter from the first flute.

2. The apparatus of claim 1, further comprising:

a pair of belt drums, at least one of the pair of belt drums being driven, the continuous belt being trained about the pair of belt drums, and each belt drum having a horizontal axis of rotation, the horizontal axes of rotation being parallel.

3. The apparatus of claim 2, further comprising:

complementary sprockets on an outside of each belt drum of the pair of belt drums and an underside of the continuous belt, the complementary sprockets on each belt drum being in interlocking engagement with the complementary sprockets on the underside of the continuous belt.

4. The apparatus of claim 1, wherein the at least one drum between each hopper and the continuous belt includes a cooperating vacuum-assisted flute configured to position and place the pair of first filter segments and the second filter segment onto the first flute.

5. The apparatus of claim 1, wherein the takeoff drum includes a cooperating vacuum-assisted flute configured to remove the assembled compound filter from the first flute and configured to deliver the assembled compound filter in a downstream direction.

6. The apparatus of claim 1, further comprising:

an assembly drum configured to position a wrapped tobacco rod at each end of the assembled compound filter after the assembled compound filter is removed from the first flute; and a roller configured to secure the wrapped tobacco rod at each end of the assembled compound filter with tipping paper.

7. The apparatus of claim 6, further including:

a cutter downstream of the roller, the cutter configured to cut the assembled compound filter in two at a midpoint of the assembled compound filter so as to produce two cigarettes, each including a compound filter with a wrapped tobacco rod secured thereto with tipping paper.

8. The apparatus of claim 1, wherein the continuous belt has a linear path of travel.

9. The apparatus of claim 1, wherein the plurality of spaced apart hoppers are serially arranged relative to a path of travel of the continuous belt.

10. The apparatus of claim 1, wherein the at least one drum between each hopper and the continuous belt includes a vacuum, the vacuum configured to provide vacuum-assisted transfer between each hopper and the continuous belt.

11. The apparatus of claim 1, wherein the takeoff drum includes a vacuum, the vacuum configured to provide vacuum-assisted transfer from the continuous belt.

12. The apparatus of claim 1, further comprising:

a fourth hopper configured to supply a pair of fourth filter segments; and a fourth drum configured to deliver the pair of fourth filter segments from the fourth hopper to the first flute, the fourth drum delivering the pair of fourth filter segments, respectively, to positions adjacent each of the pair of first and third filter segments.

13. The apparatus of claim 12, further comprising:

a cutter downstream of the takeoff drum, the cutter configured to cut the assembled compound filter in two at a midpoint of the second filter segment.

* * * * *